US010252124B2

(12) United States Patent
Trahan et al.

(10) Patent No.: US 10,252,124 B2
(45) **Date of Patent: *Apr. 9, 2019**

(54) PUTTER-TYPE GOLF CLUB HEAD

(71) Applicant: DUNLOP SPORTS CO. LTD., Kobe-shi, Hyogo (JP)

(72) Inventors: Nick Trahan, Huntington Beach, CA (US); Thomas Carlson, Newport Beach, CA (US); Christopher R. Cooper, Orange, CA (US); Adam Sheldon, Long Beach, CA (US)

(73) Assignee: SUMITOMO RUBBER INDUSTRIES, LTD., Kobe (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/481,902

(22) Filed: Apr. 7, 2017

(65) Prior Publication Data

US 2017/0209755 A1 Jul. 27, 2017

Related U.S. Application Data

(62) Division of application No. 14/166,289, filed on Jan. 28, 2014, now Pat. No. 9,694,259.

(60) Provisional application No. 61/891,639, filed on Oct. 16, 2013.

(51) Int. Cl.
*A63B 53/04* (2015.01)

(52) U.S. Cl.
CPC .. *A63B 53/0487* (2013.01); *A63B 2053/0408* (2013.01); *A63B 2053/0412* (2013.01); *A63B 2053/0441* (2013.01)

(58) Field of Classification Search
USPC ..... 473/324–350
See application file for complete search history.

(56) References Cited

U.S. PATENT DOCUMENTS

| | | | |
|---|---|---|---|
| 1,291,967 | A | 1/1919 | MCDougal |
| D58,209 | S | 6/1921 | Bacheller |
| D205,041 | S | 6/1966 | Capps |
| 3,333,854 | A | 8/1967 | White |
| 3,880,430 | A | 4/1975 | McCabe |
| 4,312,509 | A | 1/1982 | Grant |
| 4,629,193 | A | 12/1986 | Pierman |

(Continued)

FOREIGN PATENT DOCUMENTS

| | | | |
|---|---|---|---|
| JP | 2008168139 | A | 7/2008 |
| WO | 2006113966 | A1 | 11/2006 |

OTHER PUBLICATIONS

May 12, 2016 Office Action issued in U.S. Appl. No. 14/166,289.

(Continued)

*Primary Examiner* — Alvin Hunter
(74) *Attorney, Agent, or Firm* — Oliff PLC

(57) ABSTRACT

A putter-type golf club head that, when oriented in a reference position, includes a striking wall extending in the heel to toe direction and defines a substantially planar striking face for hitting a golf ball. A central elongate member is in communication with, and extends rearward from, the striking wall. An upper surface of the central elongate member includes a plurality of separate alignment elements. At least one of the plurality of alignment elements has an edge that extends substantially parallel to the striking face. The length of the parallel edge is substantially equivalent to the diameter of a golf ball.

17 Claims, 8 Drawing Sheets

(56) References Cited

U.S. PATENT DOCUMENTS

| | | | |
|---|---|---|---|
| 4,688,798 | A | 8/1987 | Pelz |
| 4,754,976 | A | 7/1988 | Pelz |
| 4,795,157 | A | 1/1989 | Bencriscutto |
| 4,964,639 | A | 10/1990 | Tucker |
| 5,167,414 | A | 12/1992 | Montgomery, III |
| 5,533,728 | A | 7/1996 | Pehoski et al. |
| 5,676,603 | A | 10/1997 | Miller |
| D398,353 | S | 9/1998 | Wooten |
| 5,816,930 | A | 10/1998 | Brown |
| D401,636 | S | 11/1998 | Duclos |
| 6,045,452 | A | 4/2000 | Ahn et al. |
| 6,062,986 | A | 5/2000 | Kaise |
| D429,297 | S | 8/2000 | Hettinger |
| D441,042 | S | 4/2001 | Hettinger |
| D443,320 | S | 6/2001 | Breier et al. |
| D443,906 | S | 6/2001 | Hettinger et al. |
| 6,273,831 | B1 | 8/2001 | Dewanjee |
| D447,782 | S | 9/2001 | Hettinger et al. |
| D449,085 | S | 10/2001 | Breier et al. |
| D457,586 | S | 5/2002 | Tang et al. |
| 6,386,991 | B1 | 5/2002 | Reyes et al. |
| D458,656 | S | 6/2002 | Tang et al. |
| 6,422,949 | B1 | 7/2002 | Byrne et al. |
| 6,422,950 | B1 | 7/2002 | Whitlam |
| D461,514 | S | 8/2002 | Tang et al. |
| D461,515 | S | 8/2002 | Tang et al. |
| D461,860 | S | 8/2002 | Tang |
| D461,861 | S | 8/2002 | Tang et al. |
| D462,100 | S | 8/2002 | Breier et al. |
| D463,002 | S | 9/2002 | Tang et al. |
| 6,471,600 | B2 | 10/2002 | Tang et al. |
| D467,985 | S | 12/2002 | Tang et al. |
| 6,506,125 | B2 | 1/2003 | Helmstetter et al. |
| D470,904 | S | 2/2003 | Tang et al. |
| D471,245 | S | 3/2003 | Tang et al. |
| D471,940 | S | 3/2003 | Tang et al. |
| D472,594 | S | 4/2003 | Tang et al. |
| D472,595 | S | 4/2003 | Tang et al. |
| D481,089 | S | 10/2003 | Breier et al. |
| D485,320 | S | 1/2004 | Breier et al. |
| D485,323 | S | 1/2004 | Wagner et al. |
| D485,592 | S | 1/2004 | Hettinger et al. |
| 6,679,782 | B2 | 1/2004 | Tang et al. |
| D486,194 | S | 2/2004 | Helmstetter et al. |
| 6,692,372 | B1 | 2/2004 | Colucci |
| D488,200 | S | 4/2004 | Olsavsky et al. |
| 6,716,110 | B1 | 4/2004 | Ballow |
| D496,417 | S | 9/2004 | Tang |
| D496,418 | S | 9/2004 | Tang et al. |
| 6,793,588 | B2 | 9/2004 | Tang et al. |
| D499,777 | S | 12/2004 | Yamamoto |
| 6,837,801 | B1 | 1/2005 | Souza et al. |
| D505,703 | S | 5/2005 | Fiskari |
| D506,237 | S | 6/2005 | Byrne et al. |
| 6,905,420 | B2 | 6/2005 | Tang et al. |
| D507,319 | S | 7/2005 | Kramski |
| D508,546 | S | 8/2005 | Oldknow |
| D508,723 | S | 8/2005 | Rollinson et al. |
| 6,926,615 | B1 | 8/2005 | Souza et al. |
| 6,929,564 | B2 | 8/2005 | Olsavsky et al. |
| 6,960,140 | B2 | 11/2005 | Solheim et al. |
| 6,974,394 | B1 | 12/2005 | Tang et al. |
| D513,777 | S | 1/2006 | Cuellar |
| D514,182 | S | 1/2006 | Olsavsky et al. |
| 6,988,955 | B2 | 1/2006 | Stoakes |
| D515,647 | S | 2/2006 | Morgulis |
| 7,004,849 | B2 | 2/2006 | Cameron |
| D517,143 | S | 3/2006 | Petsel et al. |
| D519,180 | S | 4/2006 | Oldknow |
| D520,583 | S | 5/2006 | Rollinson et al. |
| 7,052,410 | B2 | 5/2006 | Cameron |
| 7,052,411 | B2 | 5/2006 | Solheim et al. |
| D523,102 | S | 6/2006 | Stites et al. |
| 7,070,516 | B2 | 7/2006 | Dewanjee et al. |
| 7,086,957 | B2 | 8/2006 | Solheim et al. |
| D532,066 | S | 11/2006 | Tang |
| D532,467 | S | 11/2006 | Aguinaldo et al. |
| D532,844 | S | 11/2006 | Rollinson |
| D532,845 | S | 11/2006 | Rollinson |
| D532,847 | S | 11/2006 | Rollinson |
| D533,242 | S | 12/2006 | Tang |
| D533,244 | S | 12/2006 | Kroll, Jr. |
| D533,613 | S | 12/2006 | Byrne et al. |
| D533,913 | S | 12/2006 | Byrne et al. |
| 7,147,569 | B2 | 12/2006 | Tang et al. |
| D534,974 | S | 1/2007 | Haack |
| 7,163,469 | B2 | 1/2007 | Bonneau |
| 7,166,036 | B2 | 1/2007 | Byrne et al. |
| 7,166,039 | B2 | 1/2007 | Hettinger et al. |
| 7,169,061 | B2 | 1/2007 | Hou |
| D539,860 | S | 4/2007 | Fussell |
| 7,232,379 | B2 | 6/2007 | Riseley |
| D548,295 | S | 8/2007 | Jertson et al. |
| D548,296 | S | 8/2007 | Rollinson |
| D549,795 | S | 8/2007 | Rollinson |
| D552,197 | S | 10/2007 | Wells et al. |
| D552,699 | S | 10/2007 | Rollinson |
| D552,700 | S | 10/2007 | Rollinson |
| D557,361 | S | 12/2007 | Rollinson |
| D561,282 | S | 2/2008 | Rollinson |
| D562,926 | S | 2/2008 | Roberts et al. |
| D564,606 | S | 3/2008 | Oldknow et al. |
| 7,344,451 | B2 | 3/2008 | Tang et al. |
| D565,681 | S | 4/2008 | Tanaka |
| D568,427 | S | 5/2008 | Nguyen et al. |
| D569,462 | S | 5/2008 | Rollinson |
| D571,878 | S | 6/2008 | Jones et al. |
| 7,387,580 | B2 | 6/2008 | Hasegawa |
| D572,331 | S | 7/2008 | Oldknow et al. |
| D572,780 | S | 7/2008 | Rollinson |
| D573,673 | S | 7/2008 | Noyes |
| D574,908 | S | 8/2008 | Hettinger et al. |
| D575,366 | S | 8/2008 | Rollinson |
| D577,085 | S | 9/2008 | Nicolette et al. |
| D577,398 | S | 9/2008 | Hilton |
| 7,435,188 | B2 | 10/2008 | Tateno et al. |
| D579,995 | S | 11/2008 | Nicolette et al. |
| D581,477 | S | 11/2008 | Burdick |
| D582,497 | S | 12/2008 | Rollinson |
| 7,481,713 | B2 | 1/2009 | Beckman |
| D588,657 | S | 3/2009 | Hettinger et al. |
| D589,575 | S | 3/2009 | Kim et al. |
| D590,034 | S | 4/2009 | Foster et al. |
| D590,035 | S | 4/2009 | Hilton |
| D590,461 | S | 4/2009 | Kim et al. |
| D590,462 | S | 4/2009 | Hettinger et al. |
| D591,371 | S | 4/2009 | Hilton |
| D591,372 | S | 4/2009 | Tang et al. |
| D591,806 | S | 5/2009 | Cameron |
| D591,807 | S | 5/2009 | Rollinson |
| D592,717 | S | 5/2009 | Rollinson |
| D594,517 | S | 6/2009 | Tang et al. |
| D595,372 | S | 6/2009 | Rollinson |
| D595,373 | S | 6/2009 | Kim et al. |
| 7,540,810 | B2 | 6/2009 | Hettinger et al. |
| D595,793 | S | 7/2009 | Rollinson |
| 7,578,752 | B1 | 8/2009 | Flores |
| D599,425 | S | 9/2009 | Laub |
| D603,006 | S | 10/2009 | Foster et al. |
| 7,611,419 | B2 | 11/2009 | O'Neill |
| D616,513 | S | 5/2010 | Feret |
| D617,857 | S | 6/2010 | Sones |
| D619,665 | S | 7/2010 | Rollinson et al. |
| 7,766,762 | B2 | 8/2010 | Stellander |
| D630,690 | S | 1/2011 | Rollinson |
| D634,801 | S | 3/2011 | Rollinson |
| D635,625 | S | 4/2011 | Rollinson |
| 7,918,745 | B2 | 4/2011 | Morris et al. |
| D638,892 | S | 5/2011 | Hettinger et al. |
| D640,341 | S | 6/2011 | Foster et al. |
| 7,955,180 | B2 | 6/2011 | Bittner |
| D641,057 | S | 7/2011 | Rollinson |
| D641,438 | S | 7/2011 | Rollinson |
| D641,439 | S | 7/2011 | Rollinson et al. |

(56) References Cited

U.S. PATENT DOCUMENTS

| | | | | |
|---|---|---|---|---|
| D641,440 | S | 7/2011 | Hettinger et al. | |
| D641,441 | S | 7/2011 | Hilton et al. | |
| D641,442 | S | 7/2011 | Rollinson | |
| D641,814 | S | 7/2011 | Hilton et al. | |
| D641,815 | S | 7/2011 | Rollinson et al. | |
| D650,459 | S | 12/2011 | Rollinson | |
| 8,246,481 | B2 | 8/2012 | Stites et al. | |
| 8,506,415 | B2 | 8/2013 | Franklin | |
| D709,971 | S | 7/2014 | Trahan et al. | |
| D709,972 | S | 7/2014 | Trahan et al. | |
| D709,973 | S | 7/2014 | Trahan et al. | |
| 8,834,285 | B2 | 9/2014 | Franklin et al. | |
| 8,900,064 | B2 | 12/2014 | Franklin | |
| 8,905,857 | B1 | 12/2014 | Eckhart | |
| D730,462 | S | 5/2015 | Becktor et al. | |
| D730,463 | S | 5/2015 | Dolezel et al. | |
| D732,120 | S | 6/2015 | Becktor et al. | |
| D732,121 | S | 6/2015 | Trahan et al. | |
| D732,122 | S | 6/2015 | Becktor | |
| D732,618 | S | 6/2015 | Becktor et al. | |
| D749,685 | S | 2/2016 | Dolezel | |
| D757,193 | S | 5/2016 | Dolezel | |
| 9,694,259 | B2 * | 7/2017 | Trahan | A63B 53/0487 |
| 9,839,822 | B2 * | 12/2017 | Becktor | A63B 53/0487 |
| 2009/0111605 | A1 | 4/2009 | Fujimoto | |
| 2009/0215547 | A1 | 8/2009 | Hegarty | |
| 2010/0173720 | A1 | 7/2010 | Kim | |

OTHER PUBLICATIONS

Jun. 16, 2016 Office Action issued in U.S. Appl. No. 14/311,047.
Oct. 11, 2016 Office Action issued in U.S. Appl. No. 14/166,289.
Dec. 30, 2016 Office Action issued in U.S. Appl. No. 14/311,047.
Dec. 29, 2016 Notice of Allowance issued in U.S. Appl. No. 14/166,289.
Dec. 27, 2018 Office Action issued in U.S. Appl. No. 15/813,944.

* cited by examiner

PUTTER-TYPE GOLF CLUB HEAD

RELATED APPLICATION

This application is a Continuation of U.S. application Ser. No. 14/166,289, filed Jan. 28, 2014, which is based on and claims benefit of U.S. Provisional Application No. 61/891,639, filed Oct. 16, 2013. A claim of priority to these prior applications is hereby made, and the disclosures of these prior applications are hereby incorporated by reference.

BACKGROUND

A critical component of effective putting is the ability to properly align a putter-type golf club with the cup. To better facilitate this proper alignment, various solutions have previously been proposed and manufactured. For example, as evidenced by U.S. Pat. Nos. D401,636 and D429,297, a putter-type golf club head has been produced with grooves on its upper surface that are perpendicular to the striking face of the club head. As evidenced by U.S. Pat. Nos. 6,905,420 and 6,679,782, a putter-type golf club head has also been produced with a "2-ball" design, in which multiple circular alignment elements are provided on the upper surface of the club head. These circular alignment elements are typically centered on an imaginary line extending rearward and perpendicularly from a center point of the striking face of the putter-type club head. Such design attempts do not, however, adequately provide feedback to the golfer in a manner that avoids strain and unnecessary mental computation. The result is a golfer's loss of confidence in his equipment and greater difficulty in applying a smooth and accurate putting stroke.

SUMMARY

The conventional grooves and circular alignment elements often fail to result in effective alignment of the putter-type golf club head with the cup, thereby frequently resulting in erroneous shots. Accordingly, it is an object of the present invention to provide a putter-type golf club head with more effective alignment elements.

According to experiments carried out by the present inventors, the presence of at least one rectangular alignment element, such as a rectangle or square, allowed a golfer to more effectively align the putter-type golf club head with the cup than the "2-ball" design. One explanation for this improvement is the right-angle characteristic of rectangles and squares, in which one edge of the at least one alignment element was parallel to the striking face of the dub head and another edge extended parallel to the travelling direction of the golf ball. Also according to the experiments carried out by the present inventors, by making the width of the at least one alignment element substantially equal to the diameter of the golf ball, heel-to-toe (translational) alignment was improved, thereby further reducing the likelihood of off-centered shots.

Thus, one example of the putter-type golf club head according to one or more aspects of the present invention may include a striking wall having a substantially planar striking face for hitting a golf ball. A central elongate member may extend rearward from the striking wall, and an upper surface of the central elongate member may include a plurality of separate alignment elements. At least one of the plurality of separate alignment elements may have an edge that extends substantially parallel to the striking face, and the length of this edge may be substantially equivalent to the diameter of a golf ball.

In another example, a putter-type golf club head according to one or more aspects of the present invention may include a striking face, a bottom surface, and a top surface opposite the bottom surface. The top surface may include a first alignment element having a generally rectangular shape. The top surface may also include a second alignment element spaced rearwardly from the first alignment element that also has a generally rectangular shape.

To accommodate the alignment elements, the putter-type golf club head, in one example according to one or more aspects of the present invention, may have a length no less than 3.50 inches. The width of the club head may be no less than its length. And the volume of the club head may be no greater than 60 cubic centimeters.

These and other features and advantages of the putter-type golf dub head according to the various aspects of the present invention will become more apparent upon consideration of the following description, drawings, and appended claims. The drawings described below are for illustrative purposes only and are not intended to limit the scope of the present invention.

BRIEF DESCRIPTION OF THE DRAWINGS

Exemplary embodiments of the present invention will now be described with reference to the accompanying drawings.

DETAILED DESCRIPTION OF THE EMBODIMENTS

Figure 1:
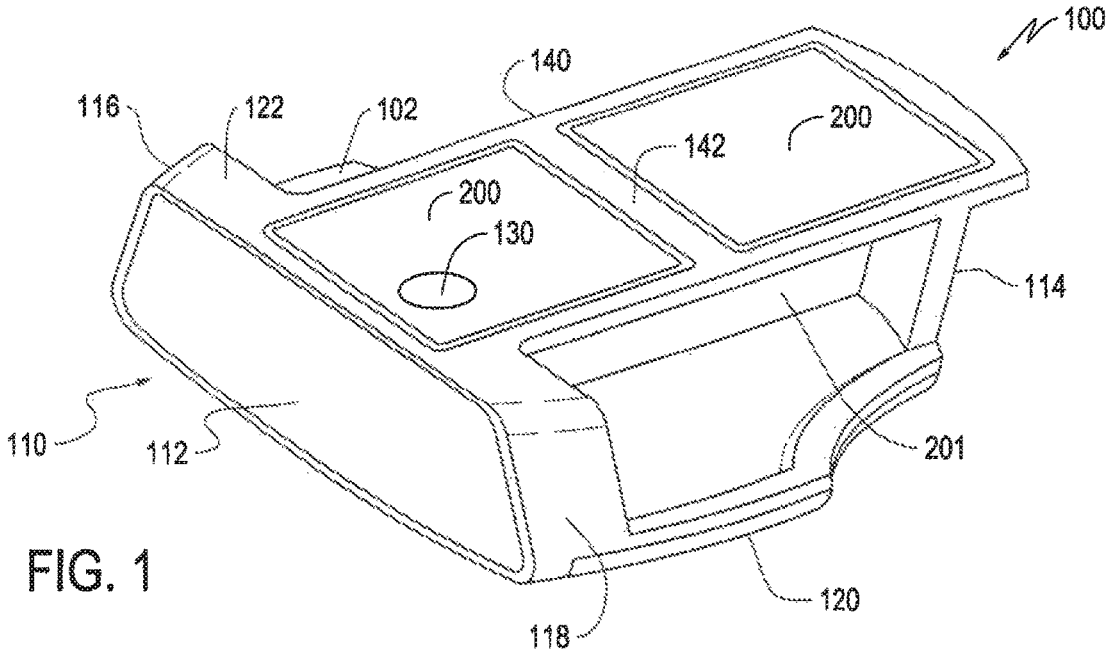
FIG. 1 shows a perspective view of an exemplary putter-type golf club head in accordance with one or more aspects of the present invention.

Referring to FIG. 1, a putter-type golf club head 100, according to one or more aspects of the present invention, may generally include a body 102 formed from metallic and/or non-metallic materials. For example, the body 102 may be formed from any one of or a combination of aluminum, stainless steel, titanium, composites, polymeric materials, and/or any other suitable material. The body 102 may include a front portion 110 having a striking surface 112, a rear portion 114, a toe portion 116, a heel portion 118, a sole portion 120, and an upper portion 122. The heel portion 118 may include a hosel 130, or aperture extending from the exterior surface of the upper portion 122, configured to receive and secure a shaft (not shown) of the golf club.

As shown, the hosel 130 is located toward the heel portion 118 of the club head 100. In certain other aspects, the hosel (or aperture) is located toward the toe portion 116 of the club head 100. In yet other aspects, the hosel (or aperture) is located in a generally central location of the club head 100 relative to the heel to toe direction.

The body 102 may also include a central elongate member 140 projecting from the striking surface 112 of the front portion 110 toward the rear of the body 102. The central elongate member 140 may include a top portion 142, an uppermost surface of which may be substantially planar and may include one or more alignment elements 200. In certain aspects, such as that shown in FIG. 1, the top portion 142 of the central elongate member 140 may be located above, and supported by, a central vertical wall 201 that extends rearwardly from the striking surface 112.

Figure 2:
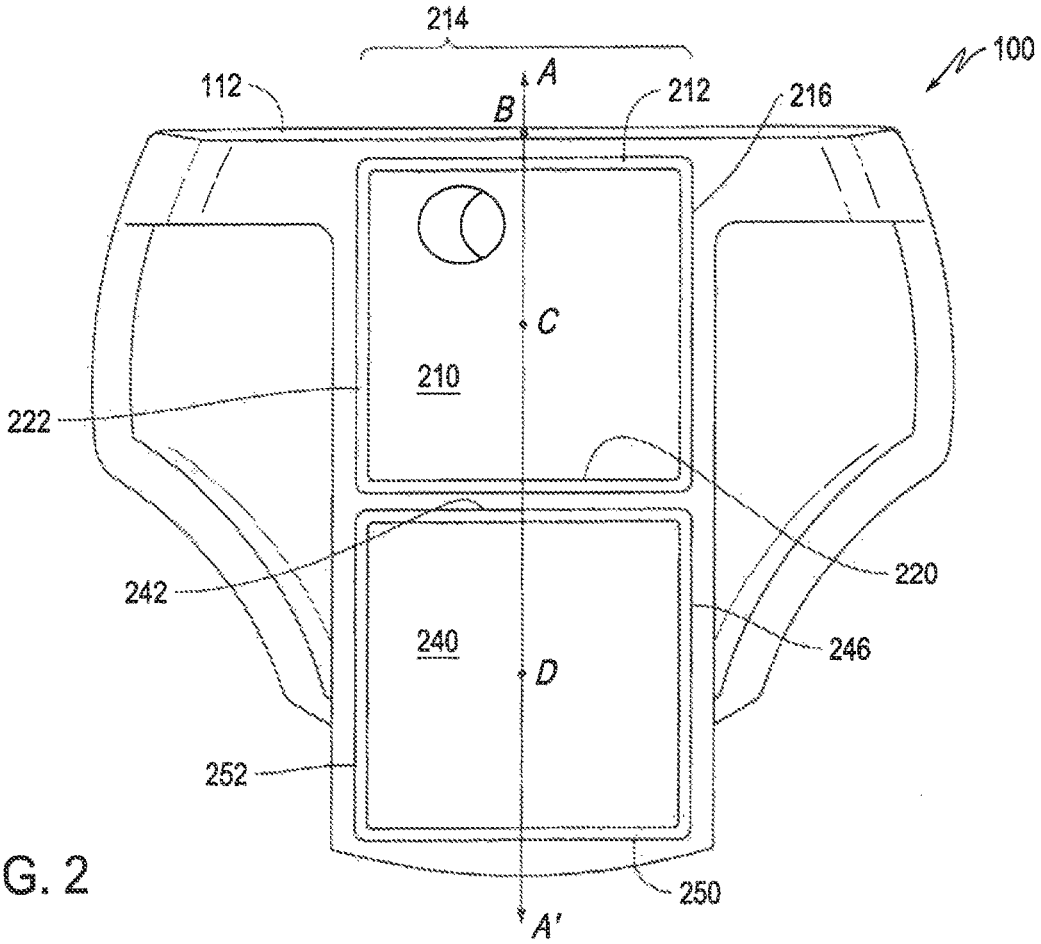
FIG. 2 shows a top plan view of the putter-type golf club head of FIG. 1.

Referring to FIG. 2, the golf club head 100 is shown in top plan view. The golf club head 100 is considered to be "soled" in this orientation with a ground plane being parallel with the plane of the paper. "Soled," as used herein, refers to an orientation of the club head 100 in which equilibrium is achieved with the club head 100 being placed so that the sole portion 120 of the club head 109 is proximate the ground plane. Unless otherwise specified, all club head dimensions described herein are taken with the club head in the "soled" position. In certain aspects, the top portion 142 of the central elongate member 140 may form a generally planar upper surface that is substantially parallel to the ground plane.

The one or more alignment elements 200 may comprise any number and any type of design sufficient to aid a golfer to align the putter-type golf club head 100 with a cup. For example, with further reference to FIG. 2, an alignment element 210 may include an edge 212 substantially parallel to the striking surface 112. An imaginary vertical plane A-A' may be perpendicular to the general plane of the striking surface 112 when the club head 100 is in the "soled" position. The edge 212 may be provided so as to be intersected by the imaginary vertical plane A-A' extending perpendicularly from the striking surface 112 toward the rear portion 114. In certain aspects, the imaginary vertical plane A-A' may intersect a center B of the striking surface 112, and in such cases, it may bisect the edge 212 into two equal halves. The length 214 of the edge 212 may be chosen to facilitate proper alignment of the golf club head 100 with the golf ball. For example, the length 214 may be equal to or substantially equal to the diameter of a golf ball, 1.62 inches ("in"). Alternatively, the length 214 may be slightly more than or slightly less than the diameter of a golf ball.

The alignment element 210 may also include an additional edge 216 that is substantially perpendicular to the edge 212. In certain aspects, the length of the edge 216 may be, like the length 214 of the edge 212, slightly less than, slightly more than, substantially equal to, or equal to the 1.62-in diameter of a golf ball. The alignment element 210 may also include additional edges. For example, the alignment element 210 may include an edge 220 parallel to the edge 212 and may include an edge 222 parallel to the edge 216. Thus, the alignment element 210 may be rectangular in shape. In certain aspects, the edges 212, 216, 220, and 222 may all be equal in length. Accordingly, the alignment element 210 may be square in shape, and its center C may be positioned on the vertical plane A-A'.

The one or more alignment elements 200 may also comprise an additional alignment element 240. For example, with further reference to FIG. 2, the alignment element 240 may be provided rearward of the alignment element 210. This second alignment element 240 may comprise edges 242, 246, 250, and 252. Edge 242, like edge 212 of the alignment element 210, may be provided substantially parallel to the striking surface 112; may have a length that is slightly less than, slightly more than, substantially equal to, or equal to the 1.62-in diameter of a golf ball; and may be bisected into equal halves by imaginary plane A-A'. Edge 246, like edge 216 of the alignment element 210, may be substantially perpendicular to the edge 242 and may, in certain aspects, have a length equal to that of the edge 242. Edges 250 and 252 may be provided so as to be respectively parallel to edges 242 and 246, thereby providing the alignment element 240 with a rectangular shape. In certain aspects, the edges 242, 246, 250, and 252 may be equal in length. Thus, the alignment element 240 may also be square in shape, and its center D may be positioned on the plane A-A'.

The edges of the alignment elements 200 may be of any kind sufficient to delineate the size and shape of the alignment elements 200. The edges may be formed, for example, as edges of shallow grooves in the top portion 142 of the central elongate member 140. These grooves may have a depth of between 0.25 millimeters ("mm") and 1.00 mm extending from the upper surface of the top portion 142 toward the ground plane. More specifically, these grooves may have a depth substantially equal to 0.50 mm. Preferably, the depth of the grooves is selected to be sufficient to enable application and retention of a paint fill.

The presence of the alignment elements 200 on the top portion 142 of the central elongate member 140 may play a role in dictating the shape and dimensions of the putter-type golf club head 100. Notably, the alignment elements 200, as they may comprise plural square-shaped elements with dimensions corresponding to a golf ball diameter, require a relative large area. In turn, these alignment elements 200 may require that a relatively significant amount of mass be placed proximate the top portion 142 of the central elongate member 140. Therefore, given a predetermined mass budget, mass in the remaining regions of the golf club head 100 may preferably be reduced. The walls forming the body 102 of the golf club head 100 may thus be generally thin-walled, and the golf club head 100 may be considered to have a high area (as projected into a ground plane when viewed in top plan) to volume ratio. Similarly, the golf club 100 may be considered to have a high length relative to its volume. Specific dimensions and properties of the golf club head 100 are discussed in detail below.

The term "volume," as used herein, denotes the volume measured using the conventional water displacement method as specified by the United States Golf Association ("USCA") and the R&A Rules Limited ("R&A"), wherein like features of wood type golf club heads are substituted for those of other types of club heads under consideration, say a putter type club head.

Figure 3:
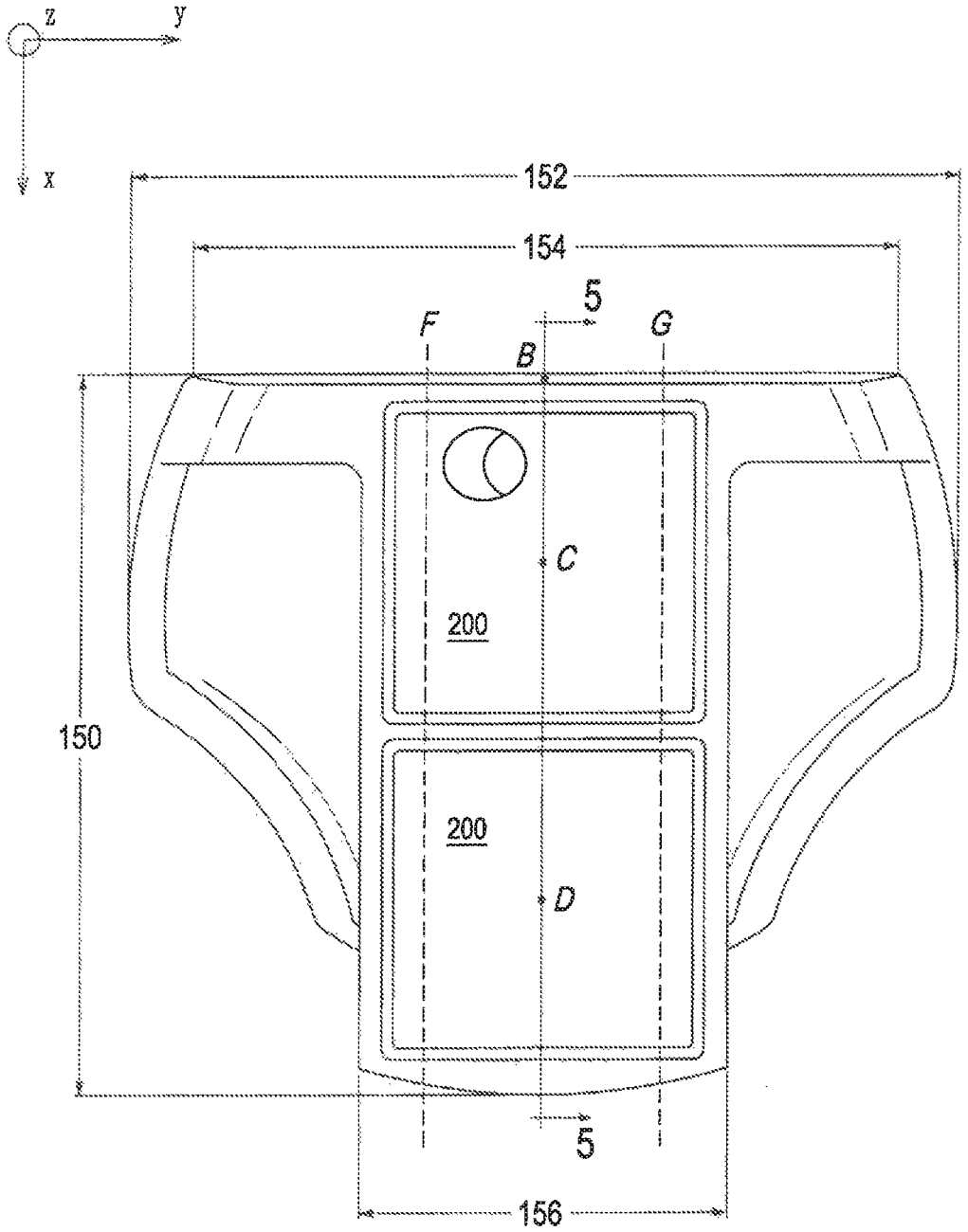
FIG. 3 shows a top plan view of the putter-type golf club head of FIG. 1.

In FIG. 3, the "soled" golf club head 100 of FIG. 2 is shown. With reference to the "x" (i.e. front to rear) direction indicated in FIG. 3, an overall length 150 of the body 102 may be greater than or equal to 3.5 in. More specifically, the length 150 may be greater than or equal to 3.55 in. Even more specifically, the length 150 may be between 3.55 and 4.0 in. With reference to the "y" (i.e. heel to toe) direction perpendicular to the "x" direction, the overall width 152 of the body 102 may be, for example, greater than the length 150. In certain aspects, the width 152 may be greater than or equal to 3.8 in. More specifically, the width 152 may be between 4.0 and 4.5 in. Even more specifically, the width 152 may be between 4.1 and 4.4 in. In certain aspects, the product ("*") of the length 150 and the width 152 may be, for example, greater than or equal to 14 $in^2$. More specifically, the product of the length 150 and the width 152 may be between 14 $in^2$ and 20 $in^2$. These dimensions ensure that the desired alignment elements may be properly sized and positioned in a club head that conforms with USGA regulations (and similar regulations of other golf equipment regulatory bodies). Defining a relatively large projected area when viewed in top plan view also ensures that the club head possesses a sufficiently high moment of inertia to provide adequate performance on off-centered shots.

Other dimensions of the body 102 may also be specified. For example, with further reference to FIG. 3, a width 154 of the striking surface 112, taken in a direction parallel to the width 152, may be less than or equal to the width 152. More specifically, the width 154 may be greater than or equal to 3.8 in. These dimensions ensure compliance with USGA regulations and, also, instill in the golfer a sense of convergence toward a golf cup, when the club head is viewed from above. This is believed to result in improved accuracy. Furthermore, the width 156 of the central elongate member 140, taken in a direction parallel to the widths 152 and 154, may be, for example, less than the widths 152 and 154. In certain aspects, the width 156 may be greater than or equal to 1.0 in. More specifically, the width 156 may be greater than or equal to 1.5 in, or the width 156 may be greater than or equal to 1.75 in. Even more specifically, the width 156 may be between 1.75 and 2.0 in. Finally, the width 156 may be substantially equal to 1.8 in. These parameters, when the club head 100 is viewed from above by a golfer, are believed to ensure continuity between the club head 100 and the golf ball intended to be contacted. Specifically, the bounds of the central elongate member 140, when the club head 100 is in a state of being swung toward a golf ball, are believed to be perceived as motion lines by the golfer. These motion lines could be projected toward the bounds of the golf ball by the golfer with minimal mental exertion. Similarly, having plural alignment elements, when the club head 100 is in a state of being swung toward a golf ball, is believed to provide an indication to the golfer of rate of travel with minimal mental exertion, which minimizes over-hitting. Specifically, the cyclical alternations between the surfaces of the alignment elements and the surrounding environment are believed to readily indicate swing speed. This effect is believed to be even further strengthened by the presence of parallel edges 212, 220, 242, and 250.

The projected area of the club head 100 when "soled" on a ground plane, and when viewed in top plan view, may be, for example, less than the product of the length 150 and the width 152. For example, the projected area of the club head 100 may be greater than or equal to 50% of the product of the length 150 and the width 152. More specifically, the projected area of the club head 100 may be greater than or equal to 65% of the product of the length 150 and the width 152. Even more specifically, the projected area of the club head 100 may be greater than or equal to 75% of the product of the length 150 and the width 152.

Figure 4:
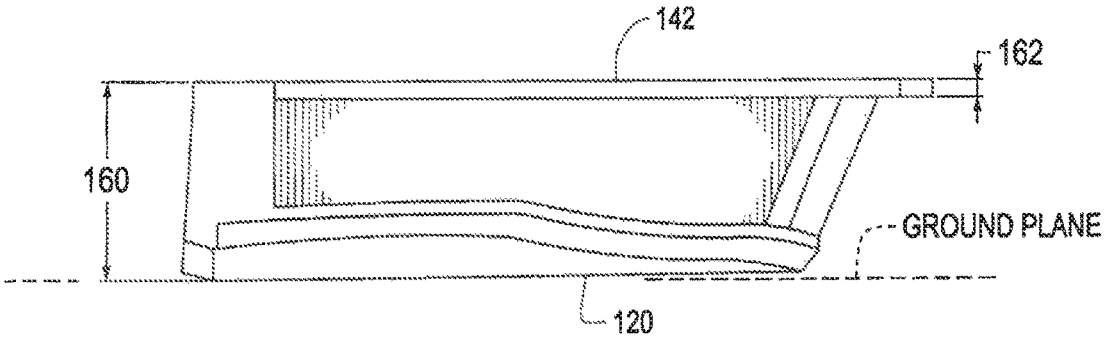
FIG. 4 shows a side view of the putter-type golf club head of FIG. 1.

The height and thickness of the body 102 may also be defined. For example, with reference to FIG. 4, the maximum height 160 from the bottommost point of the sole portion 120 to the uppermost point of the top portion 142 may be greater than or equal to 0.80 in. More specifically, the height 160 may be greater than or equal to 0.85 in. Even more specifically, the height 160 may be greater than or equal to 0.95 in. In certain aspects, the height 160 may be between 0.95 and 1.05 in. The minimum thickness 162 of the top portion 142 may also be specified. For example, the thickness 162 may be less than or equal to 5 mm. More specifically, the thickness 162 may be less than or equal to 3 mm. Even more specifically, the thickness 162 may be between 1 and 3 mm.

Figure 5:
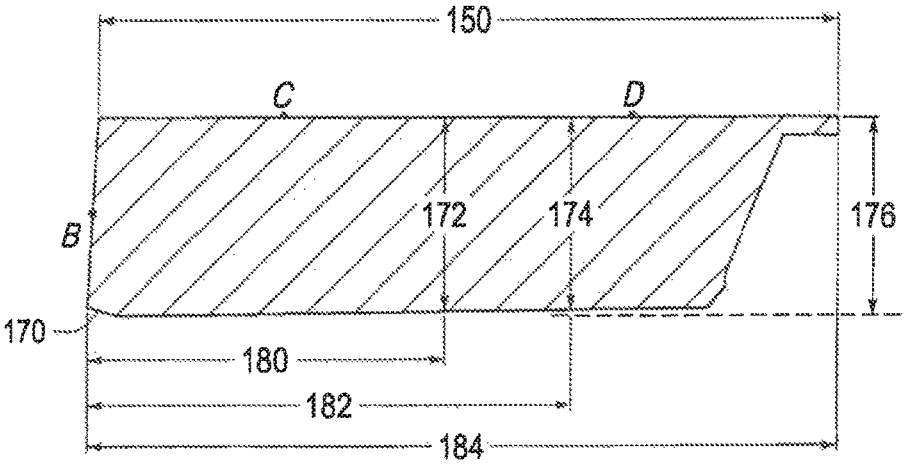
FIG. 5 shows a cross-sectional view taken along the line E-E' of FIG. 3.

FIG. 5 shows a cross-sectional view of the putter-type golf club head 100 along the line E-E' illustrated in FIG. 3. Although the line E-E' is shown as intersecting the center B of the striking surface 112 as well as the centers C and D of the alignment elements 200, this need not be the case. Rather, line E-E' may be positioned anywhere within dashed, imaginary vertical planes F and C, which are each provided 0.5 in from the center B of the striking surface 112. The height 172 is measured at a length 180 (from the forwardmost point 170), which is one half the length 150 of the body 102. The height 172 may be, for example, greater than or equal to the product of 0.5 and the maximum height 160. More specifically, the height 172 may be greater than or equal to the product of 0.75 and the maximum height 160. Even more specifically, the height 172 may be greater than or equal to the product of 0.85 and the maximum height 160. The height 174 is measured at a length 182 (from the forwardmost point 170), which is three quarters the length 150 of the body 102. The height 174 may be, for example, greater than or equal to the product of 0.5 and the maximum height 160. More specifically, the height 174 may be greater than or equal to the product of 0.75 and the maximum height 160. Even more specifically, the height 174 may be greater than or equal to the product of 0.85 and the maximum height 160, Moreover, the height 176 is measured at a length 184 (from the forwardmost point 170), which is equal to the length 150 of the body 102. The height 176 may be, for example, greater than or equal to the product of 0.5 and the maximum height 160. More specifically, the height 176 may be greater than or equal to the product of 0.75 and the maximum height 160. Even more specifically, the height 176 may be greater than or equal to the product of 0.85 and the maximum height 160.

The provision of the alignment elements 200 may in part dictate other properties of the putter-type golf club head 100. For example, the volume V of the golf club head 100 may be less than or equal to 60 cubic centimeters ("cc"). More specifically, the volume V may be less than or equal to 55 cc. Even more specifically, the volume V may be between 40 and 55 cc. In certain aspects, the volume V may be equal to or about 52 cc. The mass M of the golf club head 100 may be, for example, between 300 and 400 grams ("g"). More specifically, the mass M may be between 340 and 380 g. Even more specifically, the mass M may be substantially equal to or about 360 g. These combined mass and volume parameters ensure that, while keeping manufacturing costs low and maintaining a viable overall mass budget, the alignment features described above may be provided.

Furthermore, with reference to FIG. 3, the moment of inertia $I_{xx}$ of the putter-type golf club head 100 about an axis through the center of gravity of the club head 100 and extending parallel to the x-axis may be, for example, greater than or equal to 2,000 g*cm$^2$. The moment of inertia $I_{yy}$ of the golf club head 100 about an axis through the center of gravity of the club head 100 and extending parallel to the y-axis may be, for example, greater than or equal to 2,200 g*cm$^2$. Finally, the moment of inertia $I_{zz}$ of the golf club head 100 about an axis through the center of gravity of the club head 100 and extending parallel to the z-axis may be, for example, no less than 3,500 g*cm$^2$. More specifically, $I_{zz}$ may be no less than 4,000 g*cm$^2$. Even more specifically, $I_{zz}$ may be between 4,000 and 4,500 g*cm$^2$.

In the above discussion, a non-limiting example of the one or more alignment elements 200 has been described. By virtue of the right-angle characteristics of the alignment elements 200, superior alignment of the putter-type golf club head 100 with the cup may be achieved. Moreover, by virtue of the correspondence between the dimensions of the one or more alignment elements 200 and the diameter of the golf ball, heel-to-toe alignment of the golf ball with the golf club head 100 may be improved, thereby increasing the likelihood of an effective shot.

Figure 6:
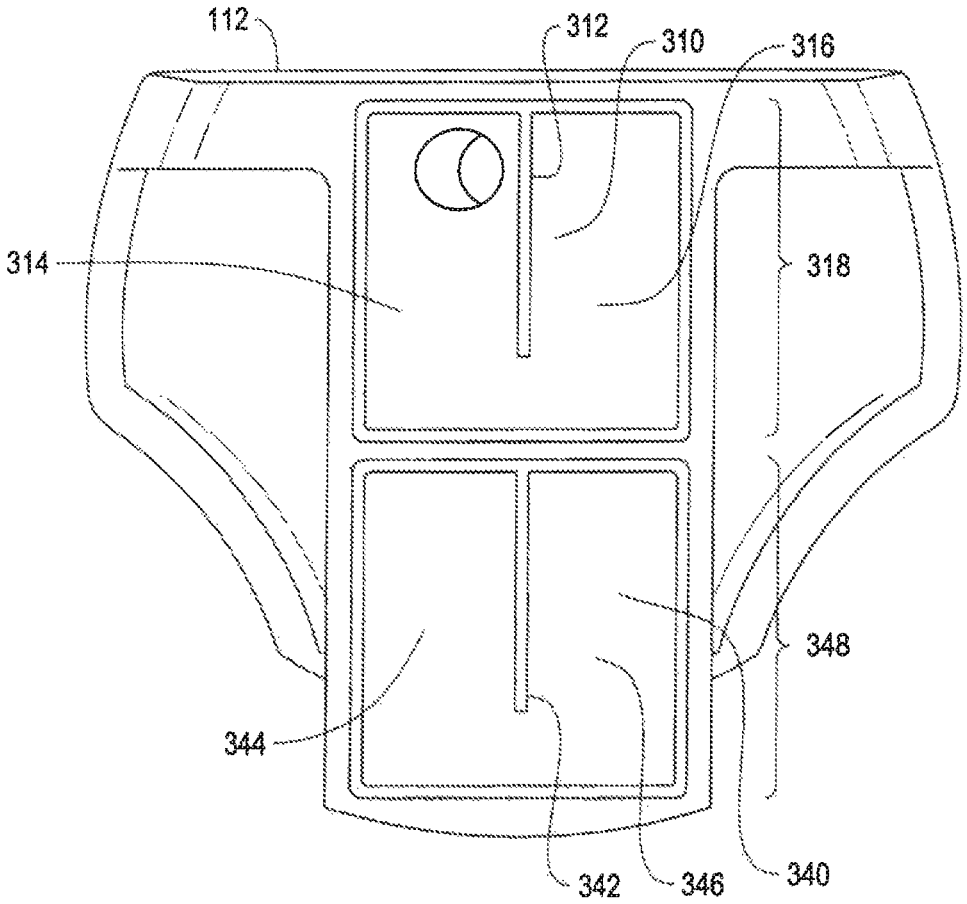
FIG. 6 shows a top plan view of an exemplary putter-type golf club head in accordance with one or more aspects of the present invention.

Other non-limiting examples of the alignment elements are envisioned as being within the scope of the invention. For example, FIG. 6 shows alignment element 310. Alignment element 310 may substantially correspond to alignment element 210 in size and in position on the top portion 142 of the central elongate member 140; however, alignment element 310 may also include a guide line 312. The guide line 312 may be formed in the same manner as the edges of the alignment element 310, say as a groove. As shown in FIG. 6, the guide line 312 may extend perpendicularly to the striking surface 112, and it may run centrally through the alignment element 310 so as to divide the alignment element 310 into two equal portions 314, 316. As shown in FIG. 6, the guide line 312 may extend from the edge of the alignment element 310 closest to the striking surface 112 more than half the length 318 of the alignment element 310 so as to allow the portions 314, 316 to connect. Alternatively, the guide line 312 may extend the entire length 318 of the alignment element 310 so as to completely separate the portions 314, 316. In certain other aspects, the guide line 312 may be intermittent, e.g. dashed.

Another alignment element 340 may also be provided. The alignment element 340 may substantially correspond to alignment element 240 in size and in position on the top portion 142 of the central elongate member 140; however, the alignment element 340 may also include a guide line 342. The guide line 342 may be formed in the same manner as the edges of the alignment element 340, say as a groove. As shown in FIG. 6, the guide line 342 may extend perpendicularly to the striking surface 112, and it may run centrally through the alignment element 340 so as to divide the alignment element 340 into two equal portions 344, 346. As shown in FIG. 6, the guide line 342 may extend from the edge of the alignment element 340 closest to the striking surface 112 more than half the length 348 of the alignment element 340 so as to allow the portions 344, 346 to connect. Alternatively, the guide line 342 may extend the entire length 348 of the alignment element 340 so as to completely separate the portions 344, 346. In certain other aspects, the guide line 342 may be intermittent, e.g. dashed.

Figure 7:
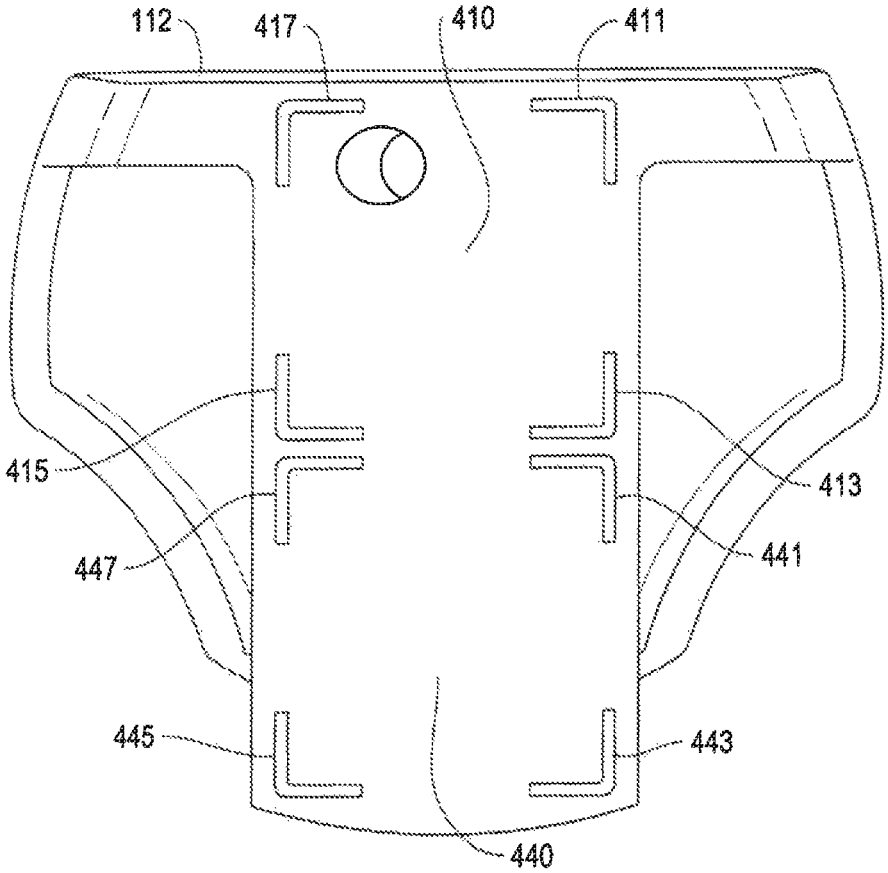
FIG. 7 shows a top plan view of an exemplary putter-type golf club head in accordance with one or more aspects of the present invention.

FIG. 7 shows another non-limiting example of the putter-type golf club head 100 according to the present invention. In this example, at least one of alignment elements 410 and 440 may be provided. Alignment elements 410 and 440 may substantially correspond to alignment elements 210 and 240, respectively, in size and in position on the top portion 142 of the central elongate member 140. The edges of the alignment elements 410 and 440 may substantially correspond to the edges 212, 216, 220, and 222 of the alignment element 210 and to the edges 242, 246, 250, and 252 of the alignment element 240, respectively, in length and in depth of the grooves forming the edges. However, the central portions of these edges may not be recessed into the top portion 142, thereby forming the alignment elements 410 and 440 as a plurality of corners 411, 413, 415, 417, 441, 443, 445, and 447. The lengths of the grooves forming these corners of the alignment elements 410 and 440 need not be particularly limited, for the grooves need only be of sufficient length to delineate to a golfer the orientation and dimensions of the alignment elements 410 and 440. In certain aspects, the portion of each corner parallel to the striking surface 142 may be equal in length to the portion of each corner perpendicular to the striking surface 112. Alternatively, the portion of each corner parallel to the striking surface 112 may be of different length (shorter or longer) than the portion of each corner perpendicular to the striking surface 112. In certain aspects, the grooves forming the plurality of corners 411, 413, 415, 417, 441, 443, 445, and 447 may all be of equal length. Alternatively, certain corners may be of different length than others. For example, corners 411, 417, 441, and 447 may be longer than corners 413, 415, 443, and 445.

Figure 8:
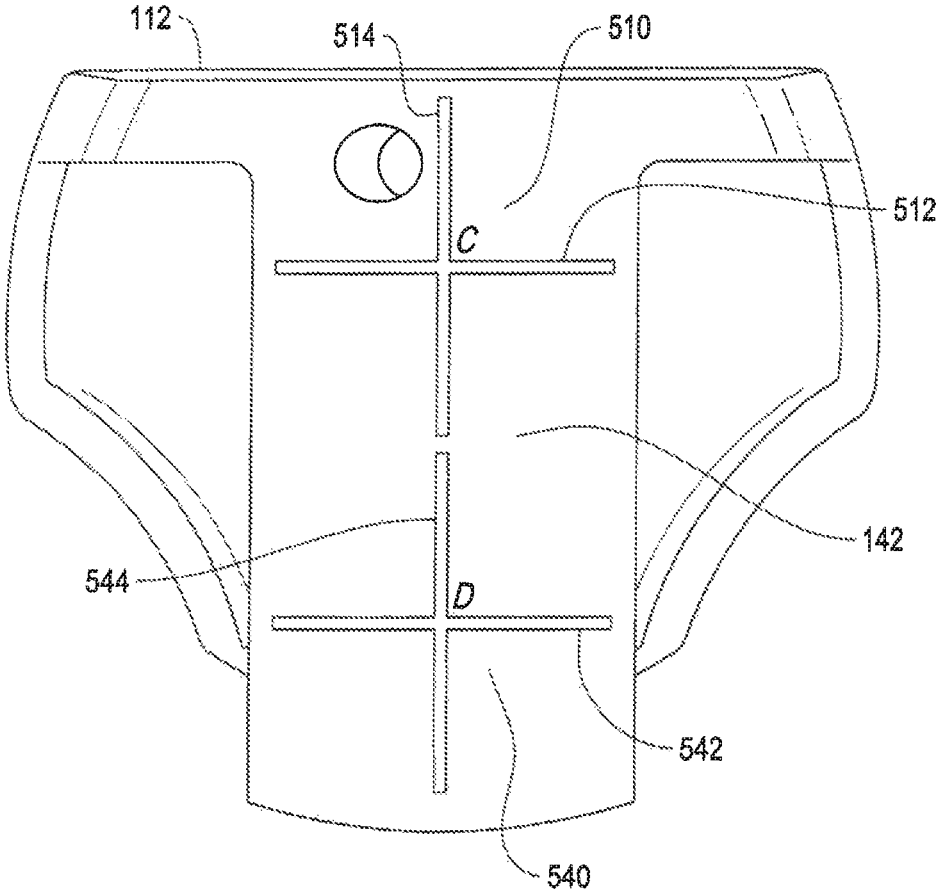
FIG. 8 shows a top plan view of an exemplary putter-type golf club head in accordance with one or more aspects of the present invention.

FIG. 8 shows another non-limiting example of the putter-type golf club head 100 according to the present invention. In this example, at least one of alignment elements 510 and 540 may be provided. Alignment elements 510 and 540 may be provided as "cross-hairs," respectively comprising edges 512, 514 and 542, 544. Edges 512, 514 and 542, 544 may be formed in a manner substantially similar to edges 212, 216, 220, 222, 242, 246, 250, and 252 of the alignment elements 210 and 240. Edges 512 and 542 may be substantially parallel to the striking surface 112, and they may be slightly less than, slightly more than, substantially equal to, or equal to the 1.62 in, diameter of a golf ball. Edges 514 and 544 may be perpendicular to the striking surface 112, and they may respectively intersect the centers of the edges 512 and 542. In certain aspects, edges 514 and 544 may also be slightly less than, slightly more than, substantially equal to, or equal to the 1.62 in. diameter of a golf ball. As seen in FIG. 8, the edges forming the alignment elements 510 and 540 may intersect at points C and D on the top surface 142, points C and D respectively corresponding to the centers of the alignment elements 210 and 240.

Figure 9:
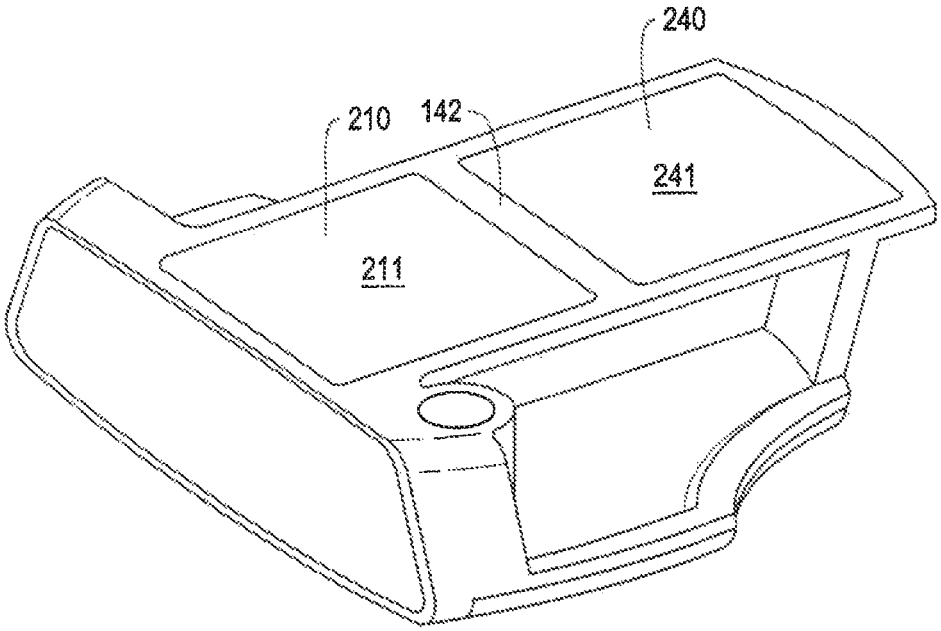
FIG. 9 shows a perspective view of an exemplary putter-type golf club head in accordance with one or more aspects of the present invention.

In the preceding examples, the alignment elements have all been formed by grooves projecting into the top surface 142 of the central elongate member 140. However, this need not be the case. For example, as illustrated in FIG. 9, at least one alignment element may be an insert provided in a corresponding opening in the top surface 142. FIG. 9 shows inserts 211 and 241 respectively forming alignment elements 210 and 240. Examples of materials suitable for fabricating the inserts may include polyurethane, silicone, Nylon, polypropylene (PP), polyethylene (PE), thermoplastic rubber (TPR), thermoplastic vulcanizate (TPV), thermoplastic polyurethane (TPU), thermoplastic elastomers (TPE), and natural rubber. The inserts may be a different color than the body 102 of the club head 100, say white, through painting or doping of the insert with coloring agents, and the inserts may be bonded to the central elongate member 140 using, e.g., an epoxy-type adhesive. The thickness of the inserts is not particularly limited, but in certain aspects, the thickness of the inserts may be less than the thickness 162 of the top portion 142.

Figure 10:
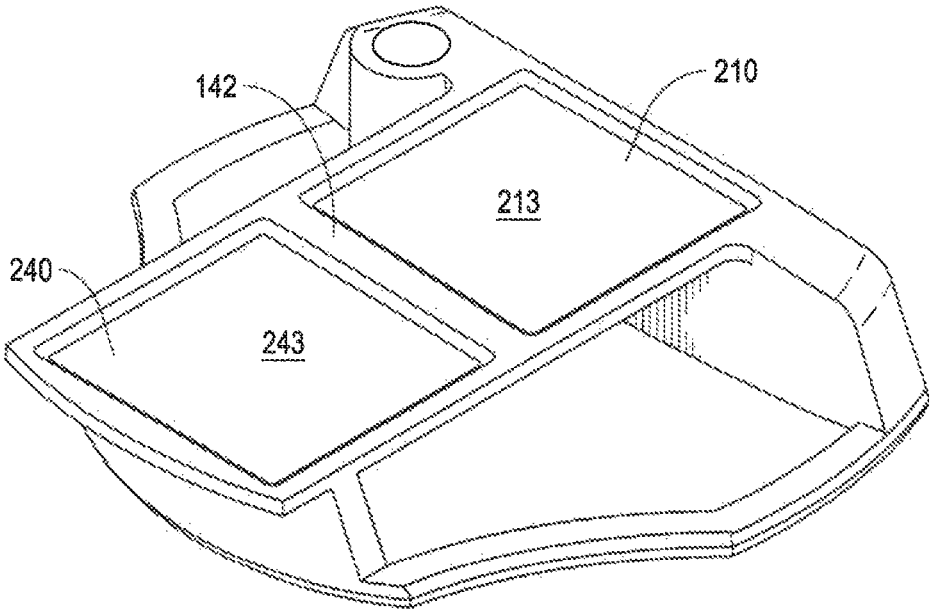
FIG. 10 shows a perspective view of an exemplary putter-type golf club head in accordance with one or more aspects of the present invention.

In other examples, such as that illustrated in FIG. 10, at least one of the alignment elements may be recessed into the top surface 142 of the central elongate member 140, FIG. 10 shows the edges of the alignment elements 210 and 240 not as grooves, but as beveled edges projecting from the uppermost surface of the top portion 142 into the top portion 142. Center, recessed portions 213 and 243 of the alignment elements 210 and 240 are below (i.e. closer to the sole portion 120) than the uppermost surface of the top portion 142. In certain aspects, the beveled edges of the alignment elements 210 and 240 are a different color than the body 102 of the club head 100. In certain other aspects, the center, recessed portions 213 and 243 are a different color than the body 102 of the club head 100. In yet other aspects, both the beveled edges and the center portions 213 and 243 are a different color than the body 102.

Figure 11:
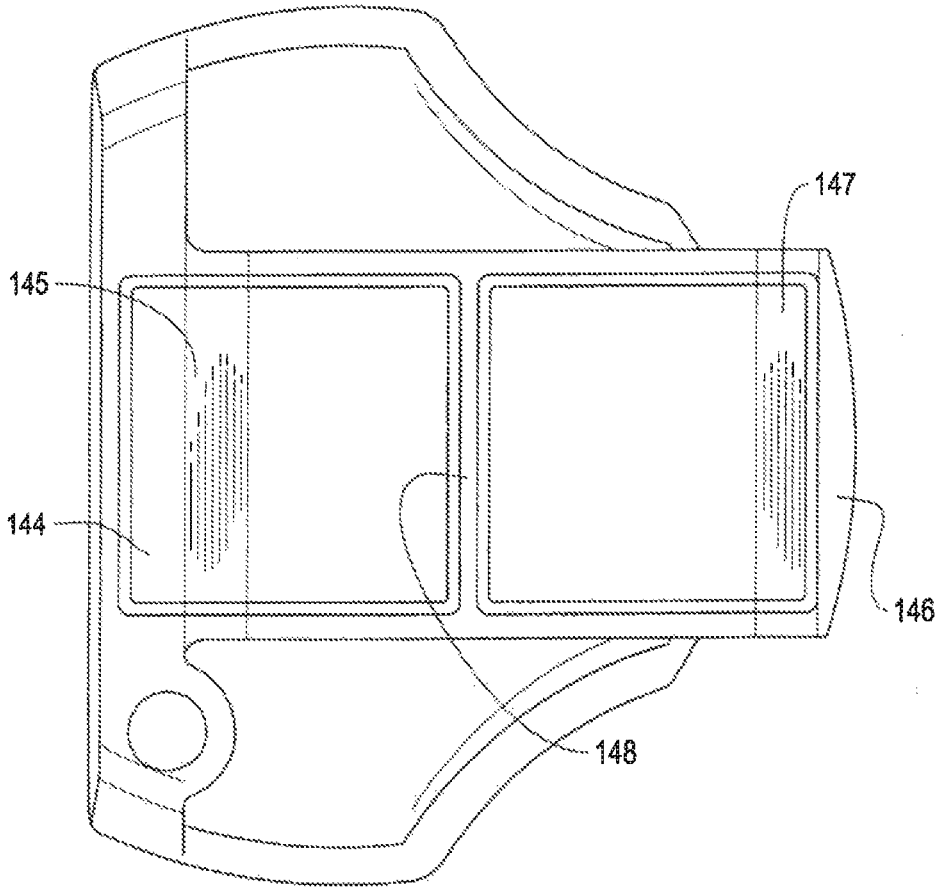
FIG. 11 shows a top plan view of an exemplary putter-type golf club head in accordance with one or more aspects of the present invention.
Figure 12:
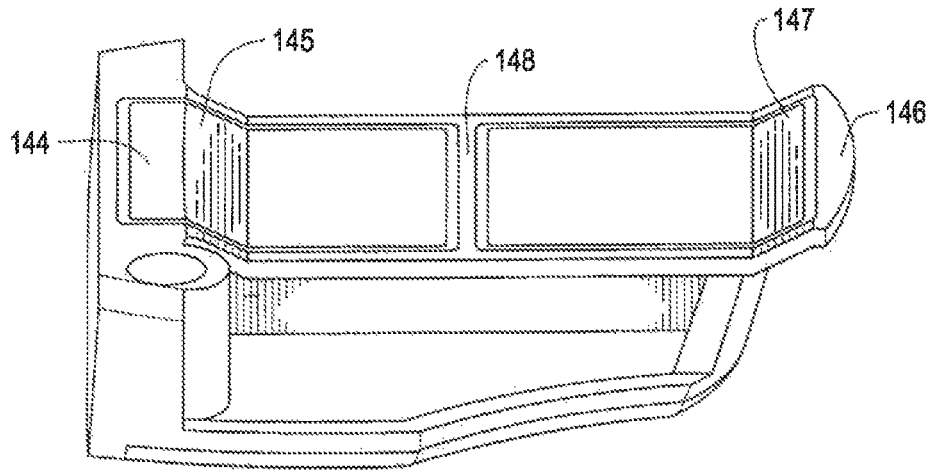
FIG. 12 shows a side perspective view of the putter-type golf club head of FIG. 11.

Even further non-limiting examples are envisioned as being within the scope of the present invention. For example, as shown in FIGS. 11 and 12, the top surface 142 of the central elongate member 140 need not be planar. Rather, the top surface 142 may comprise a front portion 144, a rear portion 146, and a central portion 148 that is recessed from the portions 144, 146 toward the sole portion 120. Beveled connecting portions 145 and 147 may respectively connect the portions 144, 148 and 146, 148. As shown in FIG. 11, when viewed from directly above by a golfer in the reference position, the alignment elements 210 and 240 appear as squares.

In the foregoing discussion, the present invention has been described with reference to specific exemplary aspects thereof. However, it will be evident that various modifications and changes may be made to these exemplary aspects without departing from the broader spirit and scope of the invention. Accordingly, the foregoing discussion and the accompanying drawings are to be regarded as merely illustrative of the present invention rather than as limiting its scope in any manner.

What is claimed is:

1. A putter-type golf club head that, when oriented in a reference position, comprises:

a striking wall extending in a heel-to-toe direction and comprising a striking surface including a face center;

a central elongate member in communication with, and extending rearwardly from, the striking wall, the central elongate member including a top wall and a sole wall defining at least one hollow region therebetween, the top wall having a minimum thickness less than or equal to 5 mm;

a width W no less than 3.8 in;

a length L such that L*W is greater than 14 $in^2$;

a mass between 300 g and 400 g;

a volume no greater than 60 cc;

a moment of inertia about a vertical axis extending through a center of gravity of the golf club head greater than or equal to 3,500 $g*cm^2$; and a maximum height hmax no less than 0.80 in, wherein in a vertical cross-section that is perpendicular to the striking surface and horizontally spaced from the face center by no greater than 0.5 in:

the club head includes, specific to the vertical cross-section, a forwardmost point and a rearwardmost point opposite the forwardmost point; and a first height h1 of no less than 0.75*hmax, the first height h1 measured at a first rearward distance d1 equal to 0.5*L, the first rearward distance measured from the forwardmost point.

2. The putter-type golf club head of claim 1, wherein, in the vertical cross-section, the club head further includes a second height h2 of no less than 0.75*hmax, the second height h2 measured at a second rearward distance d2 equal to 0.75*L, the second rearward distance d2 measured from the forwardmost point.

3. The putter-type golf club head of claim 2, wherein the vertical cross-section passes through the face center.

4. The putter-type golf club head of claim 1, wherein the top wall of the central elongate member comprises a generally planar top surface having a width no less than 1.0 in.

5. The putter-type golf club head of claim 4, wherein the top wall and the sole wall define only one hollow region therebetween.

6. The putter-type golf club head of claim 1, wherein the top wall and the sole wall define more than one hollow region therebetween.

7. The putter-type golf club head of claim 1, wherein the hollow region is not entirely enclosed.

8. The putter-type golf club head of claim 1, further comprising a volume no greater than 55 cc.

9. The putter-type golf club head of claim 1, wherein the mass is between 340 g and 380 g.

10. A putter-type golf club head having a heel and toe defining a heel-to-toe direction and that, when oriented in a reference position, comprises:

a volume no greater than 60 cc;

a length L;

a width W not less than L;

a striking wall extending in the heel-to-toe direction and comprising a substantially planar striking surface including a face center;

a central elongate member in communication with, and extending rearwardly from, the striking wall, the central elongate member including a top wall and a sole wall defining at least one hollow region therebetween;

an upper surface of the central elongate member comprising a plurality of alignment elements each having a length and a width substantially equivalent to the diameter of a golf ball, each of the plurality of alignment elements comprising a geometric center intersected by an imaginary vertical plane extending perpendicular to the substantially planar striking surface;

a moment of inertia about a vertical axis extending through a center of gravity of the golf club head greater than or equal to 3,500 $g*cm^2$; and a maximum height hmax no less than 0.80 in, wherein in a vertical cross-section that is perpendicular to the striking surface and horizontally spaced from the face center by no greater than 0.5 in:

the club head includes, specific to the vertical cross-section, a forwardmost point and a rearwardmost point opposite the forwardmost point; and a first height h1 of no less than 0.75*hmax, the first height h1 measured at a first rearward distance d1 equal to 0.5*L, the first rearward distance measured from the forwardmost point.

11. The putter-type golf club head of claim 10, wherein the at least one alignment element has a perpendicular visual indicator section that extends substantially perpendicular to a parallel visual indicator section, the parallel visual indicator section substantially parallel to the substantially planar striking surface, the perpendicular visual indicator section and the parallel visual indicator section being substantially equal in length.

12. The putter-type golf club head of claim 11, wherein the at least one alignment element comprises four sides substantially defining a square, the square being defined at least in part by the parallel visual indicator section and by the perpendicular visual indicator section.

13. The putter-type golf club head of claim 10, wherein the hollow region is not entirely enclosed.

14. The putter-type golf club head of claim 10, wherein a mass of the club head is between 340 g and 380 g.

15. The putter-type golf club head of claim 10, wherein each of the plurality of alignment elements are spaced rearwardly from the striking wall.

16. The putter-type golf club head of claim 10, wherein L is greater than or equal to 3.5 in.

17. The putter-type golf club head of claim 10, wherein the top wall of the central elongate member has a minimum thickness no greater than 5 mm.

* * * * *